US008607571B2

(12) United States Patent
Williams et al.

(10) Patent No.: US 8,607,571 B2
(45) Date of Patent: Dec. 17, 2013

(54) LEAN BURN INJECTORS HAVING A MAIN FUEL CIRCUIT AND ONE OF MULTIPLE PILOT FUEL CIRCUITS WITH PREFILIMING AIR-BLAST ATOMIZERS

(75) Inventors: Brandon P. Williams, Urbandale, IA (US); Jeremy T. Rhyan, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 1125 days.

(21) Appl. No.: 12/562,398

(22) Filed: Sep. 18, 2009

(65) Prior Publication Data

US 2011/0067403 A1 Mar. 24, 2011

(51) Int. Cl.
*F23R 3/14* (2006.01)

(52) U.S. Cl.
USPC ..... 60/743; 60/748; 60/742; 60/740

(58) Field of Classification Search
USPC ..... 60/740, 742, 748, 737, 743
See application file for complete search history.

(56) References Cited

U.S. PATENT DOCUMENTS

| | | | | |
|---|---|---|---|---|
| 2,703,260 | A | 3/1955 | Olson et al. | |
| 3,899,884 | A | 8/1975 | Ekstedt | |
| 3,980,233 | A | 9/1976 | Simmons et al. | |
| 4,139,157 | A * | 2/1979 | Simmons | 239/400 |
| 4,562,698 | A * | 1/1986 | Halvorsen et al. | 60/740 |
| 4,600,151 | A | 7/1986 | Bradley | |
| 5,224,333 | A | 7/1993 | Bretz et al. | |
| 6,272,840 | B1 | 8/2001 | Crocker et al. | |
| 6,389,815 | B1 | 5/2002 | Hura et al. | |
| 2005/0039456 | A1 * | 2/2005 | Hayashi | 60/737 |
| 2006/0248898 | A1 * | 11/2006 | Buelow et al. | 60/776 |
| 2007/0137207 | A1 | 6/2007 | Mancini et al. | |
| 2007/0163263 | A1 | 7/2007 | Thomson | |
| 2008/0066720 | A1 * | 3/2008 | Piper et al. | 123/470 |
| 2009/0077973 | A1 * | 3/2009 | Hu et al. | 60/741 |
| 2010/0263382 | A1 * | 10/2010 | Mancini et al. | 60/742 |

FOREIGN PATENT DOCUMENTS

| | | | |
|---|---|---|---|
| EP | 2241816 | A2 | 10/2010 |
| GB | 1549957 | A | 8/1979 |
| GB | 2451517 | A | 2/2009 |
| JP | 2010249504 | A | 11/2010 |

OTHER PUBLICATIONS

United Kingdom Examination Report dated Nov. 28, 2011 issued on United Kingdom Patent Application No. GB0907678.7.
United Kingdom Combined Search and Examination Report, dated Nov. 26, 2010 for Application No. GB1015302.1.
GB1015302.1 Seach Report dated Apr. 2011.

* cited by examiner

*Primary Examiner* — William H Rodriguez
*Assistant Examiner* — Carlos A Rivera
(74) *Attorney, Agent, or Firm* — Edwards Wildman Palmer LLP; Scott D. Wofsy; Joshua L. Jones

(57) ABSTRACT

A fuel injector for a gas turbine engine includes a nozzle body defining a central axis and having a main fuel circuit. An air circuit is formed within the nozzle body inboard of the main fuel circuit. A primary pilot fuel circuit is formed within the nozzle body inboard of the air circuit. A secondary pilot fuel circuit is formed within the nozzle body inboard of the air circuit and outboard of the primary pilot fuel circuit.

3 Claims, 6 Drawing Sheets

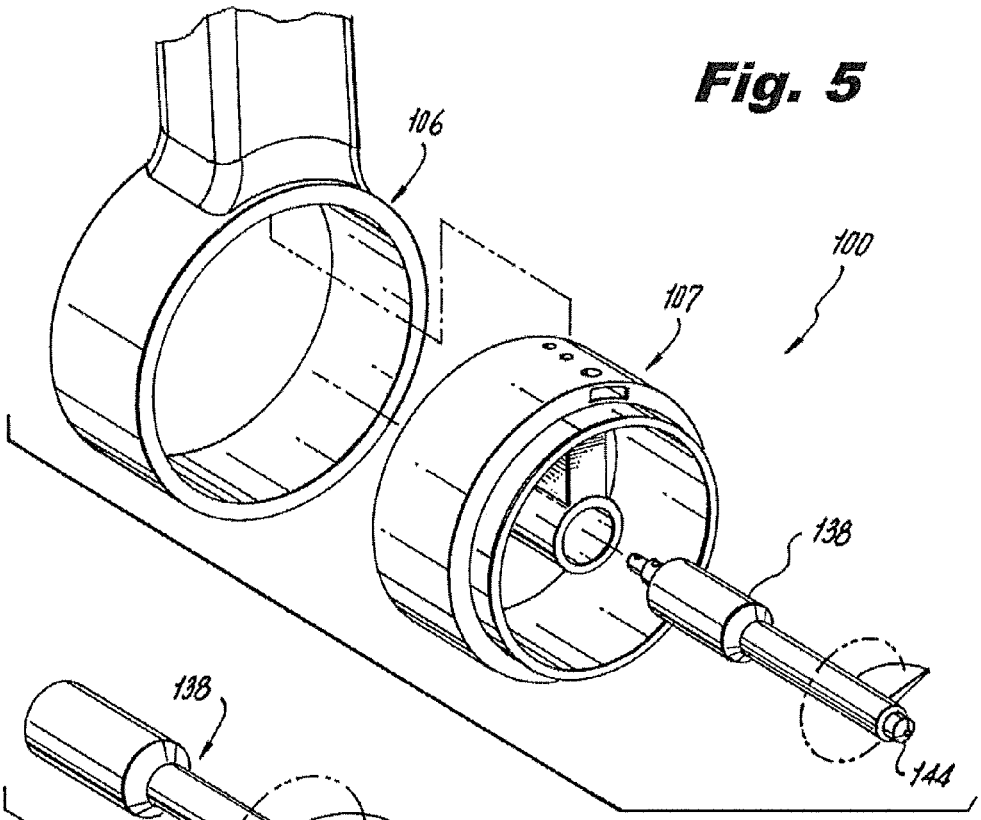
Fig. 5
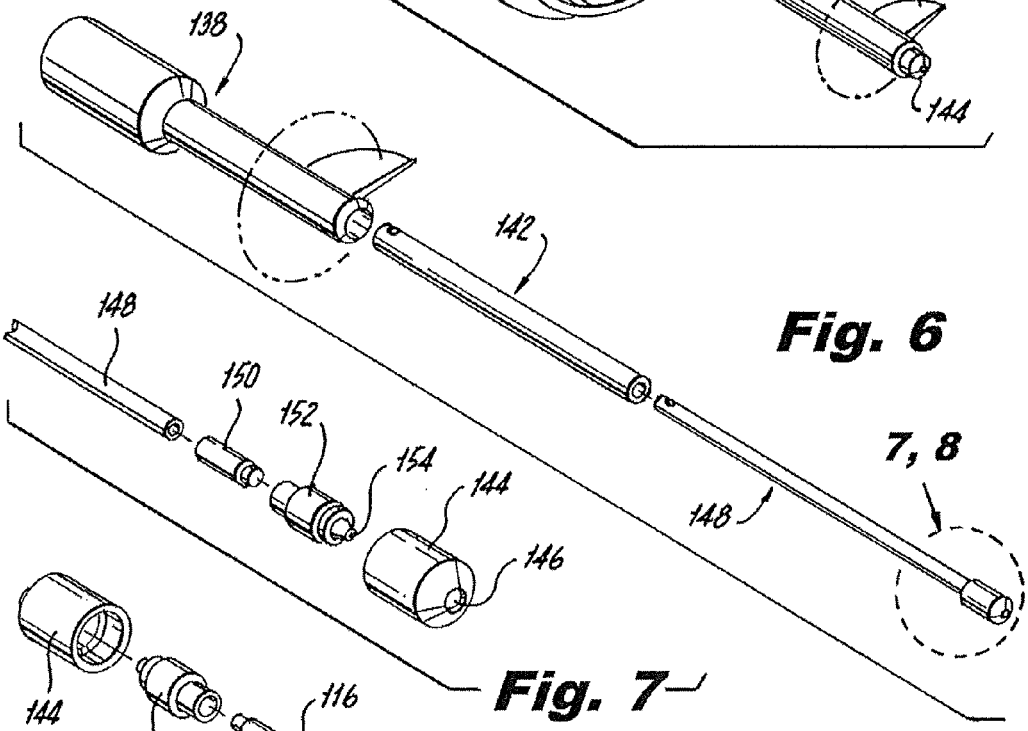
Fig. 6
Fig. 7
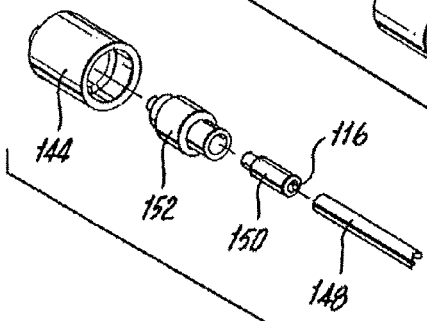
Fig. 8

LEAN BURN INJECTORS HAVING A MAIN FUEL CIRCUIT AND ONE OF MULTIPLE PILOT FUEL CIRCUITS WITH PREFILIMING AIR-BLAST ATOMIZERS

BACKGROUND OF THE INVENTION

1. Field of the Invention

The present invention relates to fuel injectors and nozzles, and more particularly to injectors and nozzles for gas turbine engines.

2. Description of Related Art

A variety of devices and methods are known in the art for injecting fuel into gas turbine engines. Of such devices, many are directed to injecting fuel into combustors of gas turbine engines while reducing undesirable emissions. With the increased regulation of emissions from gas turbine engines have come a number of concepts for reducing pollutant emissions while improving the efficiency and operability of the engines.

Modern gas turbine engine designs include providing high temperature combustion temperatures for thermal efficiency throughout a range of engine operating conditions. High temperature combustion minimizes emissions of some undesired gaseous combustion products, such as carbon monoxide (CO) and unburned hydrocarbons (UHC), and particulates, among other things. However, high temperature combustion also tends to increase the production of nitrogen oxides ($NO_X$). Thus measures must be taken to provide thermally efficient operation within a temperature range that minimizes $NO_X$, CO, and UHC.

One method often used to reduce unwanted emissions is staged fuel injection, wherein the combustion process is divided into two (or more) zones or stages, which are generally separated from each other by a physical distance, but still allowed some measure of interaction. Each stage is designed to provide a certain range of operability, while maintaining control over the levels of pollutant formation. For low power operation, only the pilot stage is active. For higher power conditions, both the pilot and the main stages may be active. In this way, proper fuel-to-air ratios can be controlled for efficient combustion, reduced emissions, and good stability. The staging can be accomplished by axial or radial separation. Staged fuel injectors for gas turbine engines are well known in the art.

It is difficult to provide thermally efficient, low emissions operation over the widening range of conditions in gas turbine engine designs. Additionally, during low power operating conditions, conventional staged fuel injectors only have fuel flowing through one of the staged fuel circuits. Measures must be taken to control temperatures in the stagnant fuel circuit to prevent coking within the injector. In the past, attempts were made to extend injector life by passively insulating, actively cooling, or otherwise protecting the fuel circuitry of fuel injectors from carbon formation during low power engine operation.

Along with staged combustion, pollutant emissions can be reduced by providing a more thoroughly mixed fuel-air mixture prior to combustion wherein the fuel-to-air ratio is below the stoichiometric level so that the combustion occurs at lean conditions. Lean burning results in lower flame temperatures than would occur with stoichiometric burning. Since the production of $NO_X$ is a strong function of temperature, a reduced flame temperature results in lower levels of $NO_X$. The technology of directly injecting liquid fuel into the combustion chamber and enabling rapid mixing with air at lean fuel-to-air ratios is called lean direct injection (LDI).

U.S. Pat. No. 6,389,815 to Hura et al. describes a lean direct injection system, which utilizes radially-staged combustion within a single injector. The pilot fuel delivery is of the "swirl-cup" type shown in U.S. Pat. No. 3,899,884 to Ekstedt, wherein a pressure swirl atomizer sprays liquid fuel onto a filming surface where the liquid film is stripped off into droplets by the action of compressor discharge air. The main fuel delivery system utilizes a series of discrete atomizers that spray radially outward into a swirling cross-flow of air. The main fuel delivery is staged radially outboard of the pilot, and operates in the fuel-lean mode. Separation of the pilot combustion zone from the main combustion zone is achieved by radial separation as well as an air jet located radially between the two combustion zones.

U.S. Pat. No. 6,272,840 to Crocker et al. discloses a lean direct injection system, which also utilizes radially-staged combustion within a single injector. The pilot fuel delivery is of either a simplex air-blast type, or a prefilming air-blast type, and the main fuel delivery system is of a prefilming air-blast type. The radial staging of the pilot and main combustion zones is achieved by ensuring that the pilot combustion zone remains on-axis with no central recirculation zone.

U.K. Patent Application No. GB 2 451 517 to Shui-Chi et al. describes a pilot circuit divided into a primary and secondary fuel split. The primary circuit includes a pressure atomizer (simplex) on the centerline that is used for low power operation. The secondary pilot circuit is radially outboard of the primary circuit and is in the form of circumferentially spaced ports aimed towards the centerline. These circumferentially spaced ports are prone to external and internal carbon concerns.

Such conventional methods and systems have been generally considered satisfactory for their intended purposes. However, there still remains a continued need in the art to provide for staged operation in a pilot only mode for a substantial portion of the operating thrust while having lower requirements of fuel delivery pressure and reducing the chance of carbon formation. There also remains a need in the art for such methods and devices that are easy to make and use. The subject invention provides a solution for these problems.

SUMMARY OF THE INVENTION

The subject invention is directed to a new and useful fuel injector for a gas turbine engine. The fuel injector includes a nozzle body defining a central axis and having a main fuel circuit. An air circuit is formed within the nozzle body inboard of the main fuel circuit. A primary pilot fuel circuit is formed within the nozzle body inboard of the air circuit. A secondary pilot fuel circuit is formed within the nozzle body inboard of the air circuit and outboard of the primary pilot fuel circuit.

In accordance with certain embodiments, the fuel injector further includes a pilot air circuit inboard of the secondary pilot fuel circuit. The primary pilot fuel circuit is inboard of the pilot air circuit. At least one of the main fuel circuit and secondary pilot fuel circuit can include a prefilming air-blast atomizer, which can be a diverging prefilming air-blast atomizer. It is also contemplated that the primary pilot fuel circuit can include a pressure swirl atomizer, which can be defined in an inner air swirler along the axis of the nozzle body.

In certain embodiments, the primary pilot fuel circuit includes a primary pressure swirl atomizer on the axis of the nozzle body. The secondary pilot fuel circuit can include a secondary pressure swirl atomizer outboard of the primary pressure swirl atomizer. The primary and secondary pressure swirl atomizers can be combined as a dual orifice atomizer.

It is also contemplated that in certain embodiments each of the primary and secondary pilot fuel circuits includes a separate atomizer orifice. The fuel injector can include an outer air circuit formed in the nozzle body outboard of the main fuel circuit. The primary pilot fuel circuit can be configured and adapted to have a lower flow number than the secondary pilot fuel circuit.

The invention also provides an injector for a gas turbine engine, including a fuel feed arm configured and adapted to convey fuel from a main fuel circuit, a primary pilot fuel circuit, and a secondary pilot fuel circuit for combustion in a combustor of a gas turbine engine. A nozzle body depends from the fuel feed arm and includes a main prefilmer defining an axis. A main fuel swirler is provided inboard of the main prefilmer. The main fuel swirler and prefilmer define a portion of the main fuel circuit therebetween. At least one air swirler is provided inboard of the main fuel swirler. The main fuel swirler and the at least one air swirler define at least one air circuit therebetween. A primary pilot atomizer is provided inboard of the at least one air swirler. The primary pilot atomizer forms a portion the primary pilot fuel circuit. A secondary pilot prefilmer is provided inboard of the air swirler and outboard of the primary pilot atomizer. A secondary pilot fuel swirler is provided inboard of the secondary pilot fuel prefilmer and outboard of the primary pilot atomizer. The secondary pilot prefilmer and secondary pilot fuel swirler form a portion of the secondary pilot fuel circuit therebetween.

The invention also provides an injector for a gas turbine engine having an annular main fuel atomizer. The injector includes a fuel feed arm configured and adapted to convey fuel for combustion in a combustor of a gas turbine engine from a main fuel circuit, a primary pilot fuel circuit, and a secondary pilot fuel circuit. A nozzle body depends from the fuel feed arm and includes an annular main fuel atomizer defining an axis. The main fuel atomizer is an air-blast prefilming atomizer and defines a portion of the main fuel circuit. A primary pilot fuel atomizer is provided inboard of the annular main fuel atomizer. The primary pilot fuel atomizer is a pressure swirl atomizer and defines a portion of the primary pilot fuel circuit. A secondary pilot fuel atomizer is provided inboard of the main fuel atomizer and outboard of the primary pilot fuel atomizer. The secondary pilot fuel atomizer is an airblast prefilming atomizer and defines a portion of the secondary fuel circuit.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 5 is an exploded perspective view of a portion of the fuel injector of FIG. 1, showing the pilot fuel circuits;

FIG. 6 is an exploded perspective view of a portion of the fuel injector of FIG. 1, showing components of the secondary pilot fuel circuit;

FIG. 7 is an exploded perspective view of a portion of the fuel injector of FIG. 1, showing components of the primary pilot fuel circuit viewed from downstream;

FIG. 8 is an exploded perspective view of a portion of the fuel injector of FIG. 7, showing components of the primary pilot fuel circuit viewed from upstream.

DETAILED DESCRIPTION OF THE PREFERRED EMBODIMENTS

Figure 1:
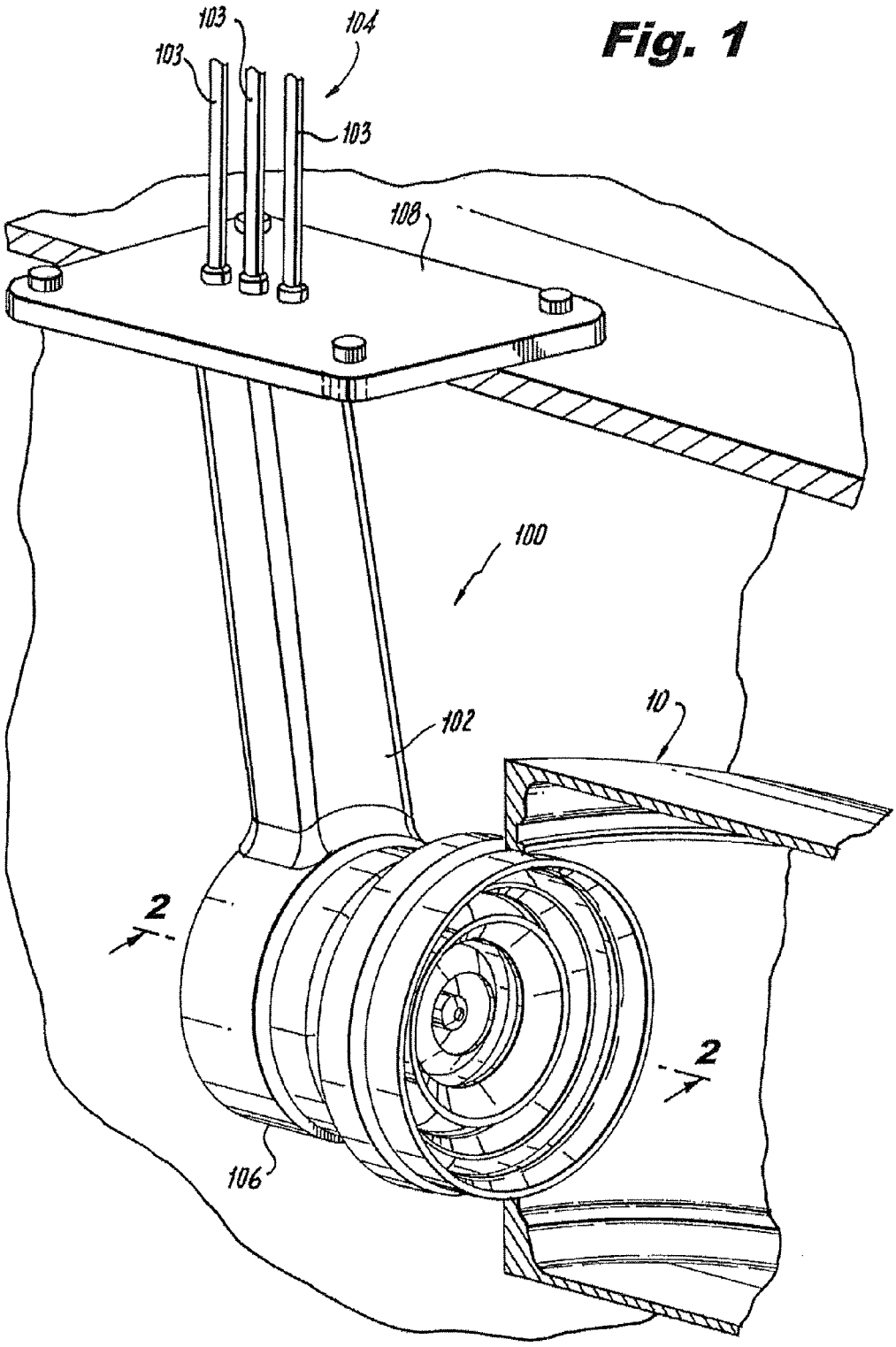
FIG. 1 is a partially cut away perspective view of an exemplary embodiment of a fuel injector constructed in accordance with the present invention, showing the injector in a combustor of a gas turbine engine.

Reference will now be made to the drawings wherein like reference numerals identify similar structural features or aspects of the subject invention. For purposes of explanation and illustration, and not limitation, a partial view of an exemplary embodiment of a fuel injector constructed in accordance with the invention is shown in FIG. 1 and is designated generally by reference character 100. Other embodiments of a fuel injector in accordance with the invention, or aspects thereof, are provided in FIGS. 2-9, as will be described.

U.S. Patent Application Publication No. 2006/0248898, which is incorporated herein by reference in its entirety, describes lean direct injection atomizers for gas turbine engines. The present invention pertains to fuel injectors that deliver a fuel/air mixture into the combustion chamber of a gas turbine engine. In particular, the invention pertains to fuel injectors for staged, lean direct injection (LDI) combustion systems, wherein around 50% to 80% of the combustion air enters the combustion chamber through the fuel injector, for example. Such a system is designed to reduce pollutant emissions, particularly nitrogen oxides ($NO_X$), carbon monoxide (CO), and unburned hydrocarbons (UHC).

There is a strong desire to operate in a pilot only mode for a substantial portion of the operating thrust, such as up to 50%-70% power or more. However, due to the desire to have good atomization for the entire range of operation which generates a high turndown ratio, the size of the pilot metering points is dictated by exterior constraints such as pump capability, manifold pressure limits and cooling requirements. The present invention allows for staging of the pilot zone into subcomponents in order to increase the operating thrust in pilot only modes without exceeding desirable pressure limits. The pilot is separated into primary and secondary pilot fuel circuits, and these can take various forms as described below.

Figure 2:
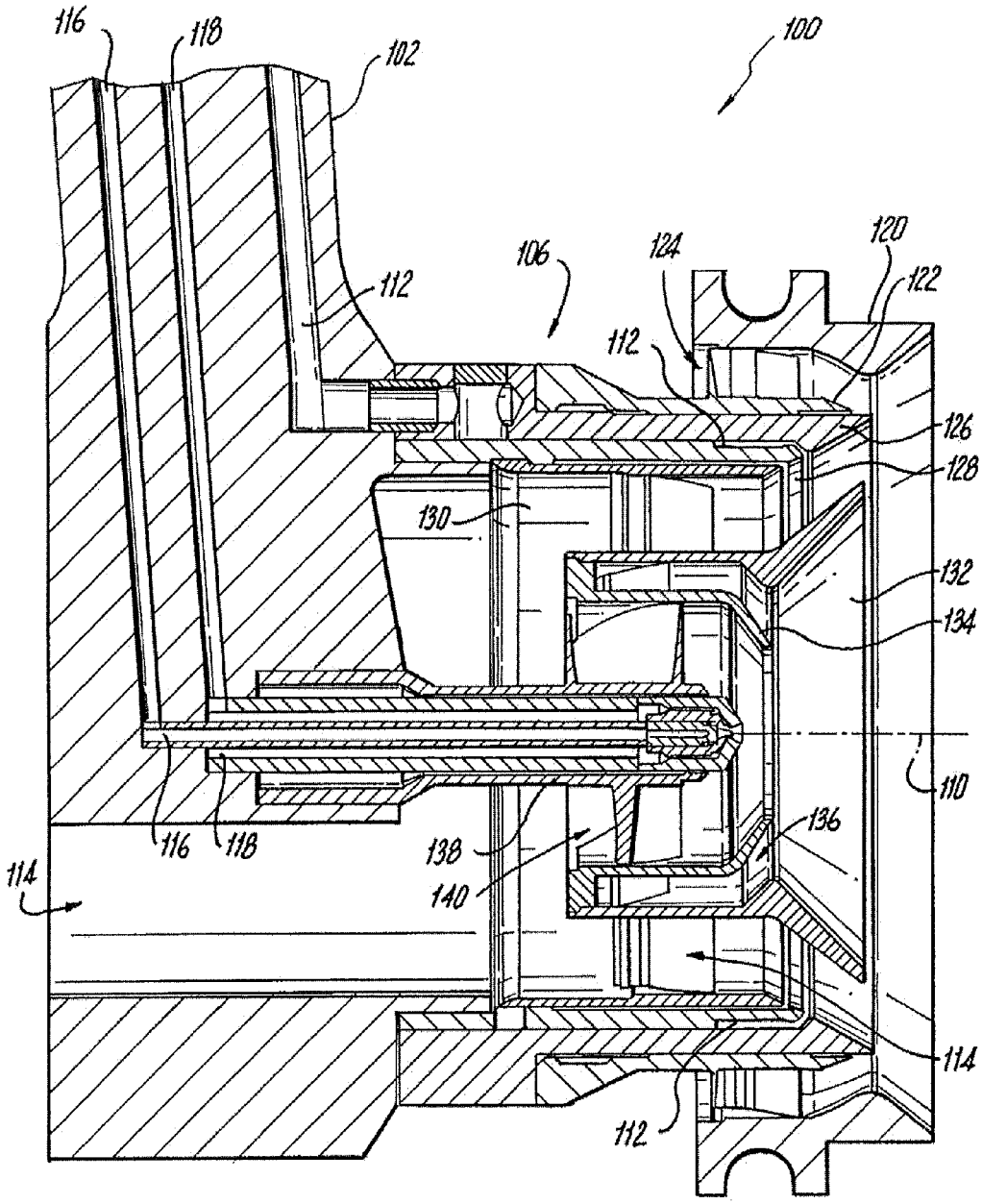
FIG. 2 is a cross-sectional side elevation view of a portion of the fuel injector of FIG. 1, showing the fuel and air circuits in the nozzle portion of the fuel injector.

As shown in FIG. 1, a fuel injector 100 for a gas turbine engine is shown mounted to a combustor 10, which is shown partially cut away. Fuel injector 100 includes an elongated feed arm 102 having an inlet portion 104 for receiving fuel at one end, and a nozzle body 106 depending from the opposite end of feed arm 102 for issuing atomized fuel into the combustion chamber of a gas turbine engine. A mounting flange 108 is provided proximate to inlet portion 104 for securing fuel injector 100 to the casing of a gas turbine engine. Fuel feed arm 102 includes fuel conduits to convey fuel from main fuel circuit 112, primary pilot fuel circuit 116, and secondary pilot fuel circuit 118 for atomization and combustion, as indicated in FIG. 2. As shown in FIG. 1, inlet portion 104 of injector 100 includes three fuel inlets 103, one for each of the three fuel circuits just mentioned. Fuel external to the injector is supplied to the three fuel circuits via the three respective inlets of inlet portion 104, from which it is conducted through conduits in feed arm 102, and is issued out of nozzle body 106 into combustor 100.

Referring now to FIG. 2, nozzle body 106 defines a central axis 110 and includes a main fuel circuit 112. An air circuit 114 is formed within nozzle body 106 inboard of main fuel circuit 112. As shown in the enlarged view of the pilot section in FIG. 3, nozzle body 106 also includes a primary pilot fuel circuit 116 and a secondary pilot fuel circuit 118. Primary pilot fuel circuit 116 is formed within nozzle body 106 inboard of secondary pilot fuel circuit 118, along the centerline of nozzle body 106, i.e. along axis 110. Secondary pilot fuel circuit 118 is formed within nozzle body 106 inboard of air circuit 114 and outboard of primary pilot fuel circuit 116.

Figure 4:
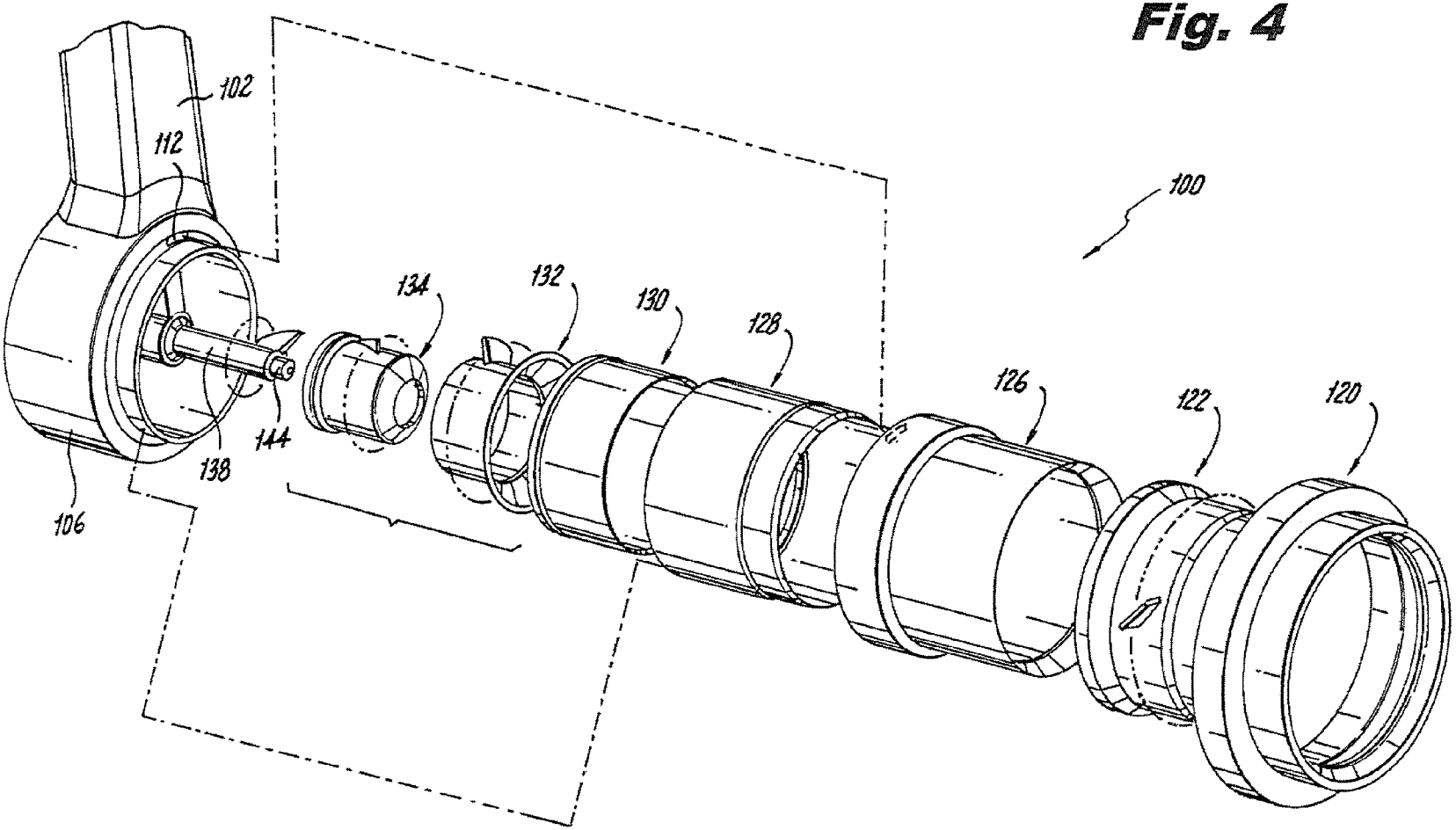
FIG. 4 is an exploded perspective view of a portion of the fuel injector of FIG. 1, showing the nozzle components of the main air and fuel circuits.

With continued reference to FIGS. 4-8, the components of nozzle body 106 defining the above-mentioned air and fuel circuits therein will be described starting from the outer components and generally working inward toward axis 110. The radially outer portion of nozzle body 106 includes an outer air cap 120 and an outer air swirler 122 inboard of outer air cap 120. An outer air circuit 124, indicated in FIG. 2, is defined between air cap 120 and outer air swirler 122, which includes swirl vanes for issuing swirled air outboard of a fuel spray issued from main fuel circuit 112. As shown in FIG. 4, a main prefilmer 126 is inboard of and generally concentric with air cap 120 and outer air swirler 122. A main fuel swirler 128 is provided inboard of main prefilmer 126. Main fuel swirler 128 and main prefilmer 126 define a portion of main fuel circuit 112 therebetween, as indicated in FIG. 2. Main fuel swirler 128 and prefilmer 126 define a generally annular prefilming atomizer that is concentric with central axis 110, and is a diverging prefilming air-blast atomizer.

Referring to FIG. 4, a heat shield 130 is disposed inboard of fuel swirler 128 to help thermally isolate fuel within main fuel circuit 112 and thereby reduce or eliminate coking therein. Main air swirler 132 is provided inboard of heat shield 130 and fuel swirler 128. Main air swirler 132 includes turning vanes similar to those of outer air swirler 122 for issuing a swirling flow of air inboard of fuel sprayed from the prefilming chamber of main fuel circuit 112. As shown in FIG. 2, The downstream portion of main air swirler 132 is conical and diverges with respect to axis 110 to direct air flowing through main air circuit 114 in a diverging direction toward fuel issuing from main fuel circuit 112.

With reference again to FIG. 4, an intermediate air swirler 134 is provided radially inward from main air swirler 132, with an intermediate air circuit 136, shown in FIG. 2, defined therebetween. Intermediate air circuit 136 provides a film of cooling air along the downstream diverging inner surface of main air swirler 132 to shield the surface from thermal damage and distress. Intermediate air swirler 134 and the diverging portion of air swirler 132 are optional. Those skilled in the art will readily appreciate that in appropriate applications, main air circuit 114 can be straight instead of diverging, for example.

Figure 3:
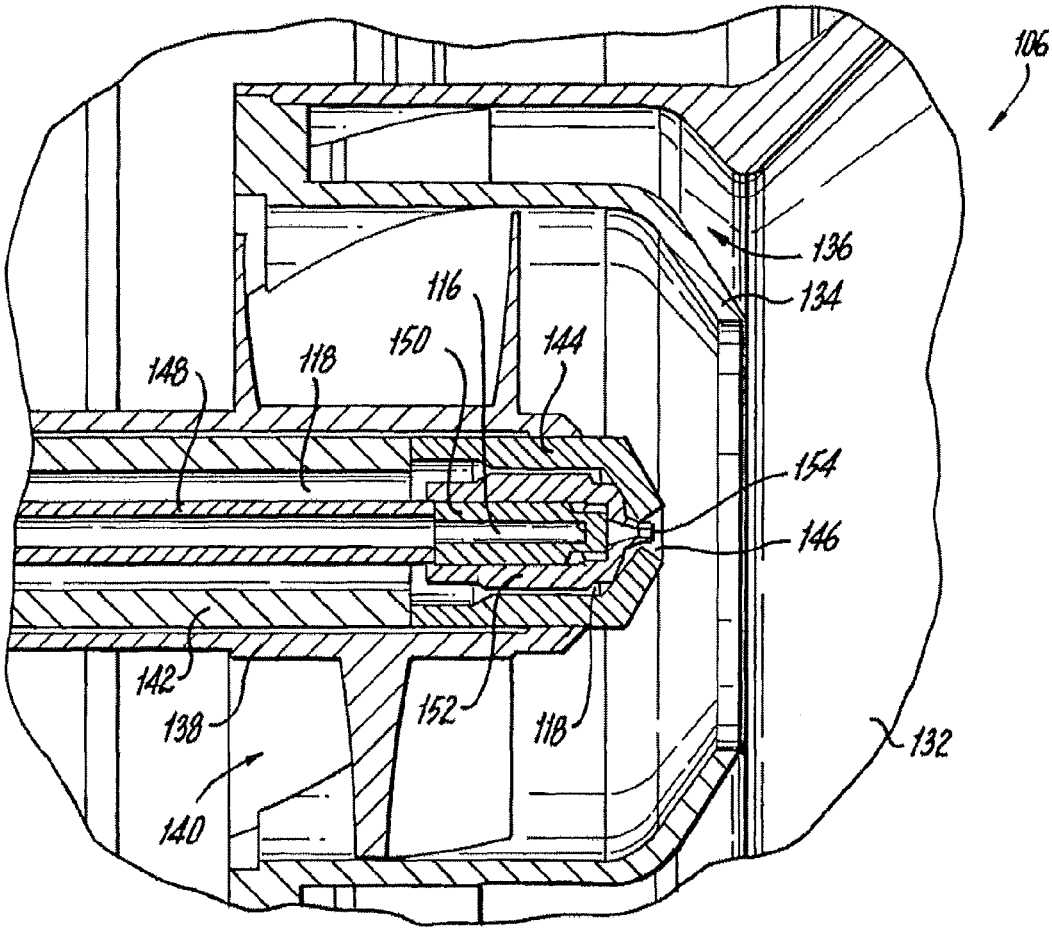
FIG. 3 is a cross-sectional side elevation view of a portion of the fuel injector of FIG. 2, showing an enlargement of the pilot fuel circuits.

Referring to FIGS. 4-5, a pilot air swirler 138 with turning vanes is provided within intermediate air swirler 134, so as to define pilot air circuit 140, which is shown in FIGS. 2 and 3 between intermediate air swirler 134 and pilot air swirler 138. The downstream portion of intermediate air swirler 134 converges toward axis 110 to direct air from pilot air circuit 140 inward toward fuel issuing from primary and/or secondary pilot fuel circuits 116, 118. Fuel in the respective fuel circuits passes from feed arm 102 to nozzle body 106 through nozzle body member 107, shown in FIG. 5.

Secondary pilot fuel circuit 118 is shielded from high temperature compressor discharge air passing through pilot air circuit 140 by pilot air swirler 138 and fuel conduit 142 inboard of pilot air swirler 138. Referring to FIGS. 3 and 6-8, Fuel passing through secondary pilot fuel circuit 118 enters between inner and outer secondary pilot fuel swirler components 144 and 152, respectively, and is issued from secondary pilot fuel orifice 146. Centerline conduit 148 conducts fuel flowing in primary pilot fuel circuit 116 along axis 110 through primary pilot fuel swirler 150 and inside secondary pilot fuel swirler component 152 to be issued through primary pilot fuel orifice 154, which is located within secondary pilot fuel orifice 146. In this manner, primary pilot fuel swirler 150 and inner and outer secondary pilot fuel swirler components 144, 152 form primary and secondary pilot fuel atomizers in the form of a dual orifice (duplex) pressure swirl atomizer.

Those skilled in the art will readily appreciate that each of the primary and secondary pilot fuel circuits can instead include a separate simplex type atomizer orifice. Those skilled in the art will also readily appreciate that the various air and fuel circuits defined in nozzle body 106 can be configured to impart co-rotational swirl or counter-rotational swirl on the respective fuel or air flow with respect to the other circuits in any suitable configuration without departing from the spirit and scope of the invention.

Injector 100 has a dual orifice (duplex) atomizer on centerline. This allows the primary pilot fuel flow to be broken down into a relatively small flow number, aiding in ignition, weak stability and low power emission. It also allows the secondary pilot fuel flow to have a comparatively large flow number allowing for higher power operation while not causing requirements for severely high fuel delivery pressures. This provides for operation of a gas turbine engine up to 50%-70% or greater throttle level without activating main fuel circuit 112, while allowing for lower fuel delivery pressure requirements compaired to conventional pilot stages operating at similar levels.

Another exemplary way of accomplishing this is to have a relatively low flow number on the centerline, again for ignition, weak stability and lower power emission, and to place radially outboard of that a prefilming airblast atomizer with a larger flow number. Such a configuration will also allow for lower requirements for fuel delivery pressure while allowing pilot-only operation up to elevated throttle levels. An example of an injector with such a configuration is described below.

Figure 9:
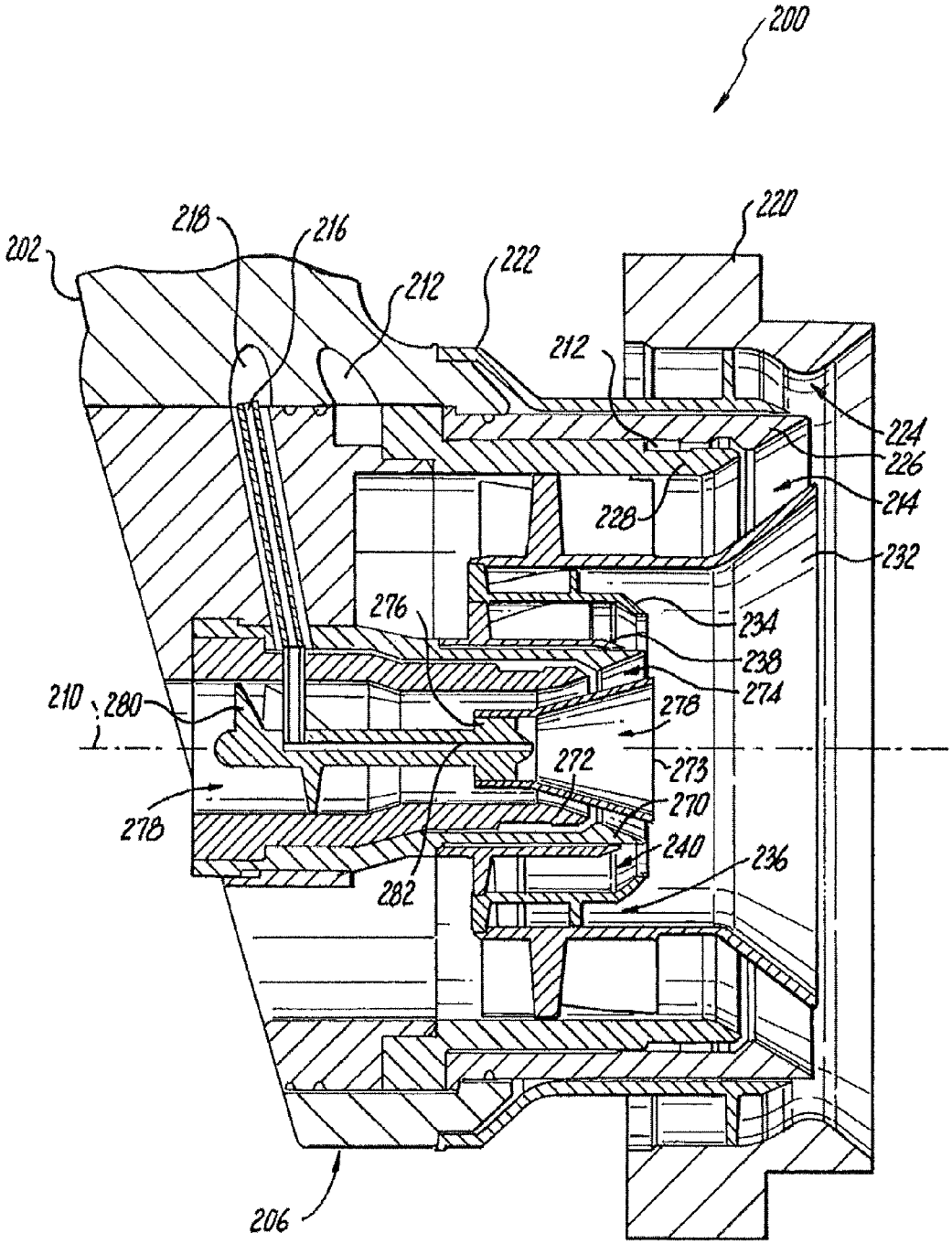
FIG. 9 is a cross-sectional side elevation view of a portion of another exemplary embodiment of a fuel injector constructed in accordance with the present invention, showing the fuel and air circuits in the nozzle portion of the fuel injector.

Referring to FIG. 9, a nozzle portion 206 of another exemplary embodiment of a fuel injector 200 constructed in accordance with the invention is shown. Injector 200 includes a feed arm 202 with main, primary pilot, and secondary pilot fuel circuits 212, 216, 218, respectively, much as described above with reference to injector 100. Nozzle body 206 includes an outer air cap 220 and outer air swirler 222 defining an outer air circuit 224 therebetween. Inboard of outer air swirler 222 is a main prefilmer 226 and main fuel swirler 228 with a main prefilming chamber defined therebetween as a portion of main fuel circuit 212, much as described above. A diverging inner air swirler 232 is positioned inside main fuel swirler 228, with a main air circuit 214 defined therebetween. An intermediate air swirler 234 is provided inside main air swirler 232 to provide cooling airflow as described above.

Injector 200 differs from injector 100 because, among other things, secondary fuel circuit 218 in injector 200 includes a prefilming atomizer instead of a pressure swirl atomizer. As such, injector 200 includes two pilot air circuits, namely inner and outer pilot air circuits, whereas injector 100 does not include an inner pilot air circuit. The prefilming atomizer of secondary pilot fuel circuit 218 is described below.

Inside intermediate air swirler 234 is an outer pilot air swirler 238, with an outer pilot air circuit 240 defined therebetween, much like pilot air circuit 140 described above. A pilot prefilmer 270 inside outer pilot air swirler 238 combines with secondary pilot fuel swirler 272 to form a prefilming chamber for secondary pilot fuel circuit 218. A conical pilot wall 273 is provided radially inward from swirler 272 for directing air through a secondary inner air circuit 274 radially outward against fuel issued from the prefilming chamber of secondary pilot fuel circuit 218. The upstream portion of conical pilot wall 273 includes swirl vanes 276 on its radially inward surface to provide swirl to air passing through primary inner pilot air circuit 278. Secondary pilot fuel circuit 218, outer pilot air circuit 240, and secondary inner air circuit 274 form a diverging pilot air-blast atomizer, which in many ways is a small scale version of the main air-blast atomizer of main fuel circuit 212.

As can be seen in FIG. 9, secondary inner pilot air circuit 274 branches off from primary inner pilot air circuit 278 at the upstream portion of conical pilot wall 273. Innermost air circuit 278 provides cooling air for pilot conical wall 273, helps atomize fuel from the pilot fuel circuits, and helps shape the mixing flow in the combustor. Upstream of this branching there is only one inner pilot air circuit, namely primary inner pilot air circuit 278. Upstream pilot air swirler 280 includes turning vanes for swirling all of the inner pilot air flow. Upstream pilot air swirler 280 includes a central bluff body that includes pilot pressure atomizer 282 therein for issuing fuel from primary pilot fuel circuit 216 along the central axis 210 of nozzle body 206. The primary pilot fuel circuit can be configured and adapted to have a lower flow number than the secondary pilot fuel circuit.

Thermal management of the three fuel circuits in injectors 100, 200 can be accomplished by cooling with fuel flowing through at least the primary pilot fuel circuit during low power engine operation to cool the other two fuel circuits when they are inactive. In general, in the feed arm 102, 202, the primary pilot fuel circuit 116, 216 should be outboard of the other two fuel circuits 112, 212, and 118, 218, and can be kept in close proximity with the other two fuel circuits 112, 212, and 118, 218 within the nozzle body, respectively. Such thermal management techniques are disclosed in commonly assigned U.S. Pat. No. 7,506,510, which is incorporated by reference herein in its entirety. The ordering of the fuel circuits described herein is exemplary and those skilled in the art will readily appreciate that the fuel circuits can be reordered as appropriate for specific applications without departing from the spirit and scope of the invention.

Injector 100 of FIG. 2 has advantageous thermal management for fuel in the pilot fuel circuits and has an increased turndown. If an existing injector design already includes a centerline pilot fuel circuit, it is possible to modify the design to include primary and secondary pilot fuel circuits as in injector 100 without an envelope change. Injector 200 of FIG. 9 also has superior properties, including the advantages of airblast atomization in the pilot fuel circuits.

The methods and systems of the present invention, as described above and shown in the drawings, provide for fuel injectors with superior properties including staged operation in a pilot only mode for a substantial portion of the operating thrust. This is accomplished while having lower requirements of fuel delivery pressure and reducing the chance of carbon formation due to thermal breakdown of fuel.

While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An injector for a gas turbine engine comprising:

a) a fuel feed arm configured and adapted to convey fuel from a main fuel circuit, a primary pilot fuel circuit, and a secondary pilot fuel circuit for combustion in a combustor of a gas turbine engine;

b) a nozzle body depending from the fuel feed arm and including a main prefilmer air-blast atomizer defining an axis;

c) a main fuel swirler inboard of the main prefilmer air-blast atomizer, the main fuel swirler and the main prefilmer air-blast atomizer defining a portion of the main fuel circuit therebetween;

d) at least one air swirler inboard of the main fuel swirler, the main fuel swirler and the at least one air swirler defining at least one air circuit therebetween;

e) a primary pilot atomizer inboard of the at least one air swirler, wherein the primary pilot atomizer forms a portion of the primary pilot fuel circuit;

f) a secondary pilot fuel swirler component inboard of the air swirler and outboard of the primary pilot atomizer, the secondary pilot fuel swirler component including a prefilming air-blast atomizer;

g) a secondary pilot fuel swirler inboard of the secondary pilot fuel swirler component and outboard of the primary pilot atomizer, the secondary pilot fuel swirler component and secondary pilot fuel swirler forming a portion of the secondary pilot fuel circuit therebetween; and h) a pilot air circuit inboard of the secondary pilot fuel swirler, wherein the primary pilot atomizer is inboard of the pilot air circuit.

2. An injector as recited in claim 1, wherein the primary pilot atomizer is a pressure swirl atomizer.

3. An injector as recited in claim 2, wherein the pressure swirl atomizer is defined in an inner air swirler along the axis of the nozzle body.

* * * * *